US005660765A

United States Patent [19]

King et al.

[11] Patent Number: 5,660,765

[45] Date of Patent: Aug. 26, 1997

[54] THERMOSTATIC ELEMENT FOR CONTROLLING A SOLENOID OPERATED CARBURETOR CHOKE

[75] Inventors: James L. King; Donald R. Fischer; Greg D. Klompenhouwer, all of Sheboygan, Wis.

[73] Assignee: Kohler Co., Kohler, Wis.

[21] Appl. No.: 669,742

[22] Filed: Jun. 26, 1996

[51] Int. Cl.[6] ..... F02M 1/12

[52] U.S. Cl. ..... 261/39.3; 261/39.6; 261/DIG. 74; 123/179.18

[58] Field of Search ..... 261/39.3, 39.6, 261/DIG. 74; 123/179.18, 438

[56] References Cited

U.S. PATENT DOCUMENTS

| | | | |
|---|---|---|---|
| 2,158,424 | 5/1939 | Hunt | 261/39.6 |
| 3,167,254 | 1/1965 | Goodyear . | |
| 3,494,598 | 2/1970 | Gordon . | |
| 3,947,531 | 3/1976 | Branigin | 261/39.6 |
| 4,003,355 | 1/1977 | Kamezaki et al. | 261/39.3 |
| 4,026,259 | 5/1977 | Meyerdierks et al. | 261/39.3 |
| 4,294,780 | 10/1981 | Du Bois et al. | 261/39.3 |
| 4,311,653 | 1/1982 | Kushida . | |
| 4,321,902 | 3/1982 | Stoltman . | |
| 4,324,745 | 4/1982 | Kono et al. . | |
| 4,463,723 | 8/1984 | Tansuwan . | |
| 4,496,496 | 1/1985 | Walstra . | |
| 4,662,333 | 5/1987 | Martel . | |
| 4,768,478 | 9/1988 | Martel . | |

*Primary Examiner*—Tim R. Miles
*Attorney, Agent, or Firm*—Quarles & Brady

[57] ABSTRACT

The air-fuel mixture produced by a carburetor is controlled by an apparatus that includes a choke valve located in a passage of the carburetor. A solenoid with a moveable plunger rod coupled to move the choke valve between extreme open and closed positions, and having a stop fixed to the plunger rod. A bimetallic element changes shape in response to changes in temperature, wherein below a given temperature the bimetallic element engages the stop thereby restricting movement of the plunger rod and preventing the choke valve from reaching the extreme open position. Above the given temperature the bimetallic element changes shape to avoid engaging the stop thereby allowing the choke valve to reach the extreme open position. A foil electric heater is mounted on a surface of the bimetallic element to match the shape of the element to the desired performance characteristic of the engine.

10 Claims, 2 Drawing Sheets

THERMOSTATIC ELEMENT FOR CONTROLLING A SOLENOID OPERATED CARBURETOR CHOKE

BACKGROUND OF THE INVENTION

The present invention relates to mechanisms for operating a choke of the carburetor on an internal combustion engine; and more particularly to a thermostatic control for such operating mechanisms.

Internal combustion engines conventionally include a system which provides fuel to the engine at a rate which varies in response to one or more operating conditions, such as the rate of air flow to the engine or a combination of engine speed and load. At each engine operating point, under normal operating temperatures, the fuel flow is carefully controlled to produce the desired engine torque.

During operation below normal operating temperatures, that same fuel flow rate may be insufficient to produce the torque required for the particular engine operating point. Accordingly, such engines conventionally include a choke or other mechanism to increase fuel flow and enrich the air-fuel mixture during low temperature operation. A sufficiently enriched air-fuel mixture assures that the engine produces adequate torque during the warm-up period before reaching the normal operating temperature range.

It has been recognized that an enriched air-fuel mixture increases fuel consumption and contributes to emission of hydrocarbons and carbon monoxide in the engine exhaust gases. Thus, in order to minimize those deleterious effects, prior cold temperature enrichment mechanisms scheduled the amount of enrichment with time, engine temperature and other engine operating conditions. Yet any such schedule is only an approximation of the cold enrichment actually required. When the cold enrichment schedule falls short of the required amount, the engine will produce insufficient torque; whereas when the schedules exceeds the required amount, the engine consumes unnecessary fuel and creates excessive exhaust emissions.

One common mechanism for controlling the choke as a function of operating temperature is a bimetallic helical spring. The device is a lamination of two metals with different coefficients of expansion, which cause the spring to curl into a tighter helix with temperature decreases and uncurl as the temperature increases. By attaching one end of the spring to the choke, the choke opens and closes with spring movement in correspondence with temperature, as described in U.S. Pat. No. 3,494,598.

Other choke control mechanisms directly connected different types of powered drivers to the carburetor choke along with the bimetallic spring thermostat to further refine the enrichment schedule to match the precise engine requirements. One of these mechanisms is shown in U.S. Pat. No. 4,321,902 in which separate linkages couple a motor and a bimetallic helical spring to the choke plate of the carburetor. The U.S. Pat. No. 4,768,478 describes using both a spring thermostat and an electric solenoid to control the position of the choke valve.

SUMMARY OF THE INVENTION

A general object of the present invention is to provide an apparatus for controlling an air-fuel mixture produced by the carburetor of an internal combustion engine.

Another object is to provide a thermostatic control of the air-fuel mixture by using a choke valve in the carburetor.

A further object is to utilize an electrically operated solenoid to control the opening and closing of the choke valve.

Yet another object of the present invention is to provide a thermostatic element to limit the degree to which the solenoid is able to open the choke valve in low temperature conditions.

These and other objectives are fulfilled by locating a movable choke valve in an air inlet passage of the carburetor. The choke valve is connected to a plunger rod of a solenoid which moves the choke valve between an extreme open position and an extreme closed position. A stop is fixed to the solenoid plunger rod.

A bimetallic element is positioned adjacent to the solenoid plunger rod. This bimetallic element changes shape in response to changes in temperature, wherein below a given temperature the plunger rod stop strikes the bimetallic element thereby restricting movement of the plunger rod and preventing the choke valve from reaching the extreme open position. Above the given temperature, the bimetallic element has changed shape to avoid being struck by the stop, thereby allowing the choke valve to reach the extreme open position.

Another aspect of this invention is to provide a heater to raise the temperature of the bimetallic element at a predefined rate to control the shape of the element in relationship to the required performance characteristics for the engine.

DETAILED DESCRIPTION OF THE INVENTION

Figure 1:
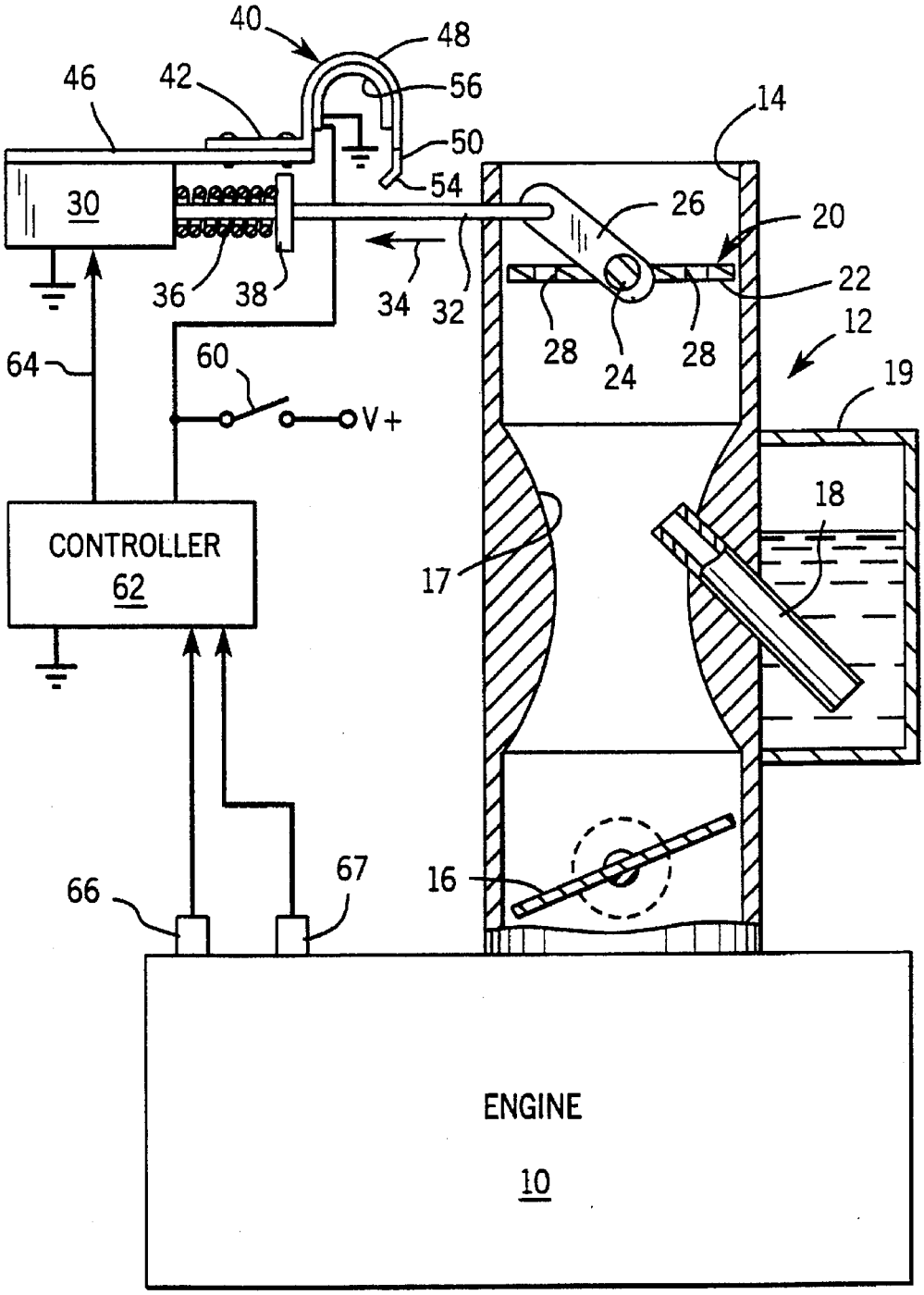
FIG. 1 is a schematic representation of an engine that incorporates the present invention for controlling a carburetor choke and shows the choke valve in a extreme closed position.

With initial reference to FIG. 1, an internal combustion engine 10 has a carburetor 12 forming a portion of an induction passage 14 that supplies combustion air to the engine. Although a vertical induction passage 14 is shown, the present invention is equally applicable to carburetors with horizontal induction passages, such as commonly used with single cylinder engines. The induction passage 14 includes a rotatable throttle valve plate 16 to control the flow rate of an air-fuel mixture therethrough to the engine. A venturi 17 creates a vacuum which varies with the rate of air flow and draws fuel from a reservoir 18 through a fuel supply passage 19. The drawn fuel is mixed in a desired ratio with the air flowing via the induction passage 14 to engine 10.

Figure 4:
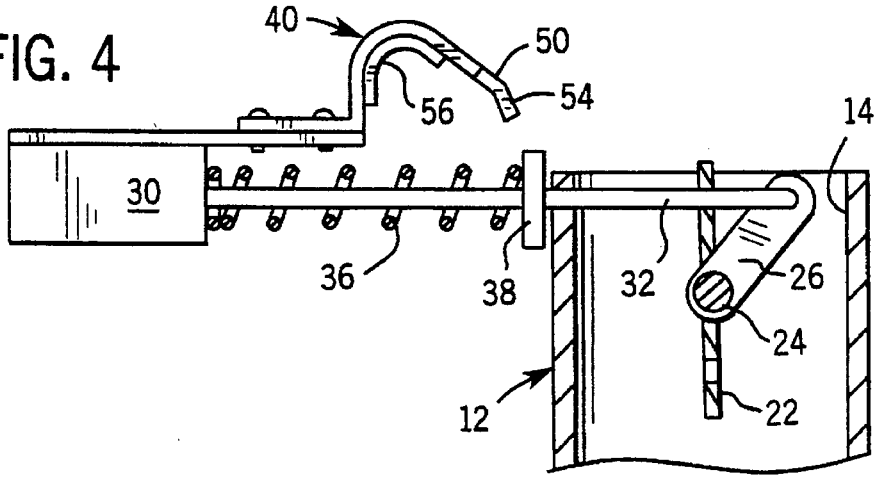
FIG. 4 is a detailed view of the control mechanism with the choke valve plate in an extreme open position.

A choke valve 20 includes a choke plate 22 located within the induction passage 14 and is able to rotate with movement of a shaft 24 that extends through apertures in the walls of the carburetor 12. A lever 26 is fixed to an end of the shaft 24 outside the induction passage 14 to rotate the shaft 24 and move the choke plate 22 between an extreme closed position and an extreme open position, shown in FIGS. 1 and 4 respectively. The choke plate 22 has apertures 28 therethrough to allow some air to flow to the engine 10 even in the fully closed position of the choke plate.

A electromagnetic solenoid 30 has a plunger rod 32 with a remote end connected to the lever 26 of the choke valve 20. When an direct electric current is supplied to the coil of the solenoid 30, the plunger 32 is drawn toward into the coil in the direction indicated by arrow 34. This action rotates the choke plate 22 into the extreme closed position illustrated in FIG. 1, where it remains as long as electric current continues to be applied to the solenoid 30. In this state a coil spring is compressed between the body of the solenoid 30 and a stop 38 affixed to the plunger rod 32.

Figure 2:
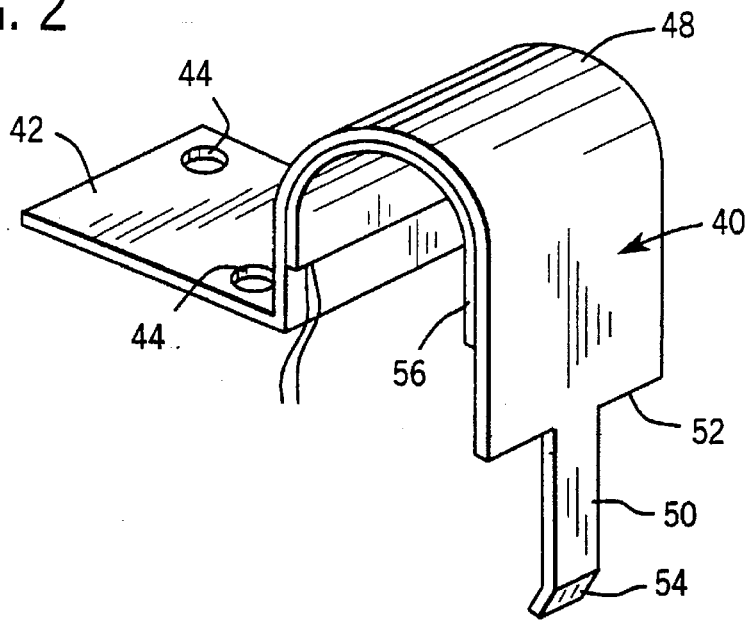
FIG. 2 is an isometric view of a bimetallic element used in the present choke control mechanism.
Figure 3:
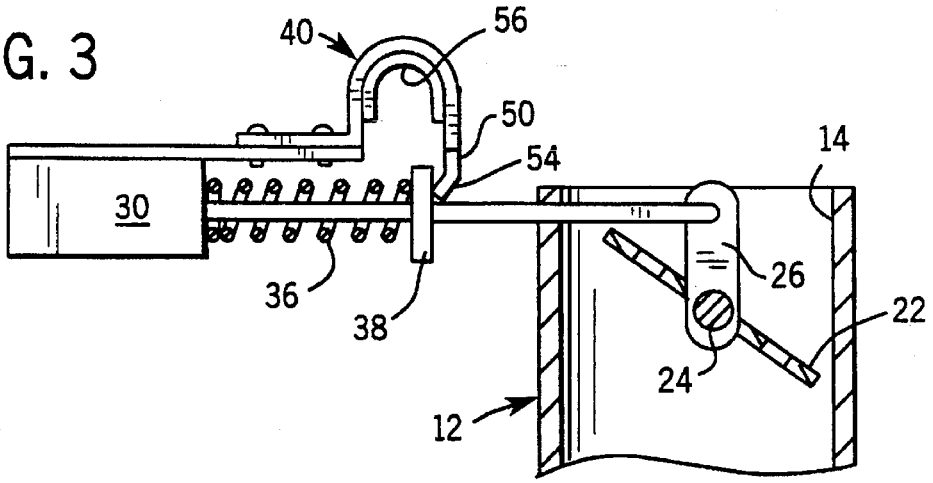
FIG. 3 is a detailed view of the control mechanism with the choke valve plate in an intermediate operating position.

When that electric current is removed, the force of coil spring 36 against the plunger stop 38 causes the valve plate 22 to rotate into an open position. The degree to which the plunger rod 32 is able to move and thus the amount to which the choke plate 22 can open is determined by the shape of a bimetallic thermostatic element 40. Below normal operating temperatures, the thermostatic element 40 appears as shown in FIG. 2, where it restricts full movement of the plunger rod 32 by striking stop 38. Thus the choke plate is unable to reach the extreme open position and may only open partially. At normal operating temperatures, the thermostatic element 40 unbends as shown in FIG. 3 and no longer restricts the plunger rod 32 allowing the choke plate 22 to reach the extreme open position.

With reference to FIGS. 1 and 2, the thermostatic element 40 is bimetallic so as to bend and unbend as a function of temperature. The thermostatic element 40 has a planar base 42 with screw holes 44 enabling attachment to a support plate 46 on the solenoid 30. Extending from one edge of the base 42 is a curved section 48 which has an inverted U-shape at relatively low temperatures (e.g. below +30° F.). A narrow arm 50 projects from the end 52 of the curved section 46 that is remote from base 42. The exposed end of the arm 50 is bent toward the base to form a claw 54. A direct current, foil type electric heater 56 is adhesively bonded to the inner diametric surface of the curved section 48 of thermostatic element 40. As will be described, heat from the foil heater 56 causes the curved section 48 to unbend when the engine is running.

When the operator desires to start the engine 10, the ignition switch is turned which closes a set of contacts 60 that applies power to the heater 56 and to a choke controller 62. The controller preferably includes a microprocessor that executes a software program which governs the operation of solenoid 30. Upon being powered-up, the controller 62 applies an electric current to the solenoid via line 64. When energized, solenoid 30 creates an internal electromagnetic field which draws the plunger 32 inward along the direction indicated by arrow 34. This action compresses the coil spring 36 between the stop 38 and body of the solenoid, and operates the lever 26 to move the choke plate 22 into the extreme closed position shown in FIG. 1.

An internal timer of controller 62 is set upon energizing the solenoid 30. After the choke valve 20 has been closed for a defined period of time, two seconds for example, the timer expires which causes the controller 62 terminate the application of electric current to the solenoid. Thus the electromagnetic field ceases and the force of the coil spring 36 moves the plunger 32 in the opposite direction of arrow 34 opening the choke valve 20. When the engine temperature is relatively cold (e.g. below +30° F.), the plunger moves until the stop 38 strikes the claw 54 on arm 50 of the bimetallic thermostatic element 40 as shown in FIG. 3. Thermostatic element 40 is sufficiently stiff to resist the force of the coil spring 36 and stop further movement of the plunger 32. Thus the choke plate 22 is held in an intermediate position between the extreme open and closed positions. This allows additional air to flow through the induction passage 14 producing a leaner air-fuel mixture that in the extreme closed position of FIG. 1.

Upon terminating the electric current to the solenoid 30, the controller 62 reads a signal from a sensor 66 which indicates the temperature of the engine block. If that temperature is less than a predefined level (e.g. 75° F. or 100° F.) that occurs after the engine has warmed-up, the controller 62 commences execution of a warm-up choke mode. Otherwise, if the engine block temperature is above the predefined level, the solenoid no longer is pulsed to close the choke valve 20. The controller may also receive other engine parameters from different sensors 67.

In the warm-up mode, the controller 62 waits 0.20 seconds after the termination of the first pulse of electric current to the solenoid 30 and then applies another current pulse for 0.10 seconds. Thereafter, the solenoid is de-energized for 0.20 seconds before current is reapplied for 0.10 seconds. The pulsing of the solenoid on for 0.10 seconds and off for 0.2 seconds repeats for 20 seconds at which time further operation of the solenoid ceases.

While the solenoid 30 is being pulsed with electric current, the foil type heater 56 is warming the bimetallic thermostatic element 40. Heat from the running engine 10 also warms the thermostatic element 40. Eventually, either during the solenoid pulsing or thereafter, the thermostatic element 40 will be heated to a temperature at which the bimetallic material begins unbending from the position shown in FIG. 2. When the unbending progresses to the point at which the claw 54 on arm 50 no longer is in contact with the plunger stop 38, the force of the coil spring 36 exerted on the stop causes the plunger 32 to extend fully from the body of solenoid 30. This action moves the choke lever 36 into the state shown in FIG. 4 where the choke valve plate 22 is in the extreme open position. At this time, the engine is in the normal operating temperature range and a normal air-fuel mixture can be used. The time between engine starting and the plunger stop clearing the thermostatic element 40 depends on the engine temperature at start-up and the ambient temperature. Therefore, the warmer the engine 10 and the warmer the ambient air, the sooner the normal air-fuel mixture will be used.

The foregoing description is directed primarily to preferred embodiments of the invention. Although some attention was given to various alternatives within the scope of the invention, it is anticipated that skilled artisans will likely realize additional alternatives that are now apparent from the disclosure of those embodiments. Accordingly, the scope of the invention should be determined from the following claims and not limited by the above disclosure.

We claim:

1. An apparatus for controlling an air-fuel mixture produced by a carburetor of an internal combustion engine, said apparatus comprising:

a choke valve located in a passage of the carburetor and having an extreme open position and an extreme closed position;

a solenoid having a moveable plunger rod coupled to the choke valve to move the choke valve between the extreme open and extreme closed positions;

a stop fixed to the plunger rod of said solenoid; and a thermostatic element which below a given temperature engages said stop thereby restricting movement of the plunger rod to prevent said choke valve from reaching the extreme open position, and above the given temperature said thermostatic element does not engage said stop to prevent the choke valve to reach the extreme open position.

2. The apparatus as recited in claim 1 further comprising a heater for raising a temperature of said thermostatic element.

3. The apparatus as recited in claim 1 further comprising an electric heater on a surface of said thermostatic element.

4. The apparatus as recited in claim 3 further comprising a control for applying electric current to said solenoid and to the electric heater.

5. The apparatus as recited in claim 1 further comprising a spring which biases the plunger rod to move the choke valve toward the extreme open position.

6. The apparatus as recited in claim 1 wherein said thermostatic element has a base portion for securing to a support member; and an arm that is movable with respect to the base portion, wherein the arm moves into a position where said stop is engaged when said thermostatic element is below the given temperature.

7. An apparatus for controlling an air-fuel mixture produced by a carburetor of an internal combustion engine, said apparatus comprising:

a choke valve located in a passage of the carburetor and having an extreme open position and an extreme closed position;

a spring coupled to bias the choke valve toward one of the extreme open and extreme closed positions;

a solenoid having a moveable plunger rod coupled to the choke valve to move the choke valve between the extreme open and extreme closed positions;

a stop fixed to the plunger rod of said solenoid;

a bimetallic element which changes shape in response to changes in temperature, wherein below a given temperature said stop strikes said bimetallic element which thereby restricts movement of the plunger rod to prevent said choke valve from reaching the extreme open position, and above the given temperature said bimetallic element has changed shape to avoid being struck by said stop thereby allowing the choke valve to reach the extreme open position; and an heater which warms said bimetallic element.

8. The apparatus as recited in claim 7 wherein said bimetallic element comprises a base portion for securing to a support member; a curved section having a first end joined to the base portion and having a second end; and an arm extending from the second end of the curved portion, wherein said stop strikes the arm when said bimetallic element is below the given temperature.

9. The apparatus as recited in claim 8 wherein said heater comprises an electric heater on a surface of the curved section of said bimetallic element.

10. The apparatus as recited in claim 7 wherein said heater comprises an electric heater on a surface of said bimetallic element.

* * * * *